United States Patent [19]

Scott et al.

[11] 4,383,715

[45] May 17, 1983

[54] WALL BRUSH

[75] Inventors: Paul E. Scott, Florence; George W. Willich, Tuscumbia; William W. Jemison, Jr., Birmingham, all of Ala.

[73] Assignee: Vulcan Materials Company, Birmingham, Ala.

[21] Appl. No.: 238,167

[22] Filed: Feb. 26, 1981

[51] Int. Cl.[3] ..... E21C 35/18

[52] U.S. Cl. ..... 299/88; 299/34

[58] Field of Search ..... 299/11, 12, 18, 32, 299/34, 36, 88, 94; 15/93 R; 172/684.5; 37/2 R; 172/770, 772

[56] References Cited

U.S. PATENT DOCUMENTS

| | | | |
|---|---|---|---|
| 610,919 | 9/1898 | Raudabaugh et al. | 172/684.5 X |
| 1,129,517 | 2/1915 | Powell | 299/34 X |
| 1,143,032 | 6/1915 | Bresee | 172/684.5 |
| 1,829,591 | 10/1931 | Goddard | 299/36 X |
| 1,910,290 | 5/1933 | Johnson | 299/36 X |
| 2,577,924 | 12/1951 | Shacikoski | 299/34 |
| 2,843,032 | 7/1958 | Jones | 172/684.5 X |

*Primary Examiner*—Ernest R. Purser

*Attorney, Agent, or Firm*—Burns, Doane, Swecker & Mathis

[57] ABSTRACT

A wall brush for dislodging loose matter from a wall face is disclosed. A plurality of x-shaped scraper elements are disposed in a plurality of beams such that end portions of each scraper element project through flange portions of its beam. An anchor chain flexibly suspends the beams. The wall brush is reciprocated on a section of the wall face until it is cleared of loose matter.

7 Claims, 4 Drawing Figures

90
85
80
80
28
50
23'
50
2
2
20
62
58
66
23
50
3
3
40
64
58
80
28
50
58
50
20
50
62
23'
66

WALL BRUSH

BACKGROUND AND SUMMARY OF THE PRESENT INVENTION

This invention relates to surface cleaning tools and more particularly to a surface cleaning tool or a wall brush for a vertical face in an earth formation.

Wall tools or wall brushes may be used for dislodging loose material such as rock from a wall face such as a quarry face or other rock face so that men and equipment can work safely on a floor below the face. It is important for safety reasons to remove loose rock or other loose matter on a wall face below which people will be working. Common sense dictates that workers should be protected from falling objects lest they be injured by loose pieces of rock or other material falling on them. Moreover, the Mine Safety and Health Administration (MSHA) has issued regulations relating to pit wall safety, see 30 CFR 56.3-1, 56.3-4 and 56.3-6.

A number of tools have been tried for dislodging loose material from a wall face including a chain attached to a winch on a front end loader and a ball and chain connected to a bull-dozer moving in a parallel direction to the wall face, thereby slamming the ball on the chain against the rock face. None of these tools have proven to be particularly successful and effective in removing loose matter from the wall face. Some of the tools did not dislodge all the loose material on the wall face and others did not have adequate flexibility and hence had an undesirable tendency to get hung up on ledges or in cracks in the wall face.

A number of different tools have been used for scraping or mining a vertical face. For example, U.S. Pat. No. 3,904,244 issued to Haspert discloses a broach which is brought into contact with a working face of a trench. The broach is suspended from a drilling rig by means of a drill stem. The broach has a cutting surface which is provided with a plurality of cutting teeth. The interior of the broach may be filled with lead or other suitable material to provide the broach with sufficient weight to force it against the working face of the trench. However, such a tool is undesirably heavy and tends to dig up the surface rather than dislodging loose material on the surface. Besides that, such a structure is not flexible enough to minimize the problem of hanging on ledges or in cracks.

U.S. Pat. No. 3,802,741 issued to Marceau discloses a scraping device for loosening damaged fire bricks in a crucible of an electric furnace. The scraping device has a beam with a scraping bit disposed on each end face thereof. As the beam is lowered on two cables into the crucible, the scraping bits, which are hingedly connected to the beam, are in an upright, nonworking position since the beam alone has a length approximately equal to the diameter of the fire bricks. The beam, including the scraping bits, has a length approximately equal to the diameter of the shell of the crucible so that when the beam reaches a working position, the bits fall down into the horizontal scraping position. The beam is then raised and lowered repeatedly to cause the bits on each end of the beam to bit into the damaged brickwork to loosen and break it up. However, such a tool has scraping bits disposed only on end faces of a beam such that the beam would have to be presented on end with respect to a wall face in order to dislodge loose material from it.

U.S. Pat. No. 3,937,162 issued to Fukutani discloses a hardened slurry demolishing device for a hold of an iron-ore carrier. A pair of telescopic cylinders suspend a horizontal arm from a traveling platform. The arm is provided at each end with a powered reciprocating breaker which is used to demolish the hardened slurry. However, such a tool is not well suited for scraping wall faces, is not flexibly suspended and requires powered scraping bits.

Still other arrangements for scraping a vertical or a horizontal surface are disclosed in U.S. Pat. No. 2,315,069 (McKeen et al), No. 2,315,252 (Fraser), No. 4,011,618 (Martin et al), No. 4,065,184 (Tipper), but each of these has been found to possess substantial practical disadvantages.

It is therefore an object of this invention to provide a wall tool or wall brush which dislodges loose material from the wall face efficiently, simply and in an economical manner.

It is another object to provide a wall tool which is flexibly suspended to minimize the problem of hanging on ledges or in cracks.

It is still another object of the present invention to provide an inexpensive wall tool or wall brush which has no moving parts.

It is yet another object to provide a wall tool or wall brush which has a plurality of prongs or cleaning teeth disposed on a longitudinal face of a beam which is wide enough and heavy enough to keep the prongs pressed against the wall face which is to be cleaned or brushed.

It is a still yet a further object to reciprocate the wall brush by a cable so that a reciprocating mechanism, for example a crane which lowers and raises the brush, can work far enough behind the wall face so that there is no danger of the weight of the crane causing the top of the wall face to collapse.

These and other objects, as well as the means for achieving them, will become more fully apparent from the specification below.

A wall brush for dislodging loose matter from a wall such as an excavation face, according to the present invention, comprises at least one X-shaped scraper element which brushes against the excavation face and dislodges loose matter therefrom. At least one housing such as a beam is provided to house the scraper element such that end portions of the scraper element project outwardly from flange portions of the beam. A suspension means, preferably an anchor chain, flexibly suspends the beam. The wall brush, which is heavy enough to keep the scraper element pressed against the wall face, is reciprocated, preferably by a crane, on a section of the wall face until it is cleared of loose matter.

BRIEF DESCRIPTION OF THE DRAWINGS

A preferred embodiment of a wall brush according to the present invention is described with reference to the accompanying drawings wherein like members bear like reference numerals and wherein.

DETAILED DESCRIPTION OF THE PREFERRED EMBODIMENT

Figure 1:
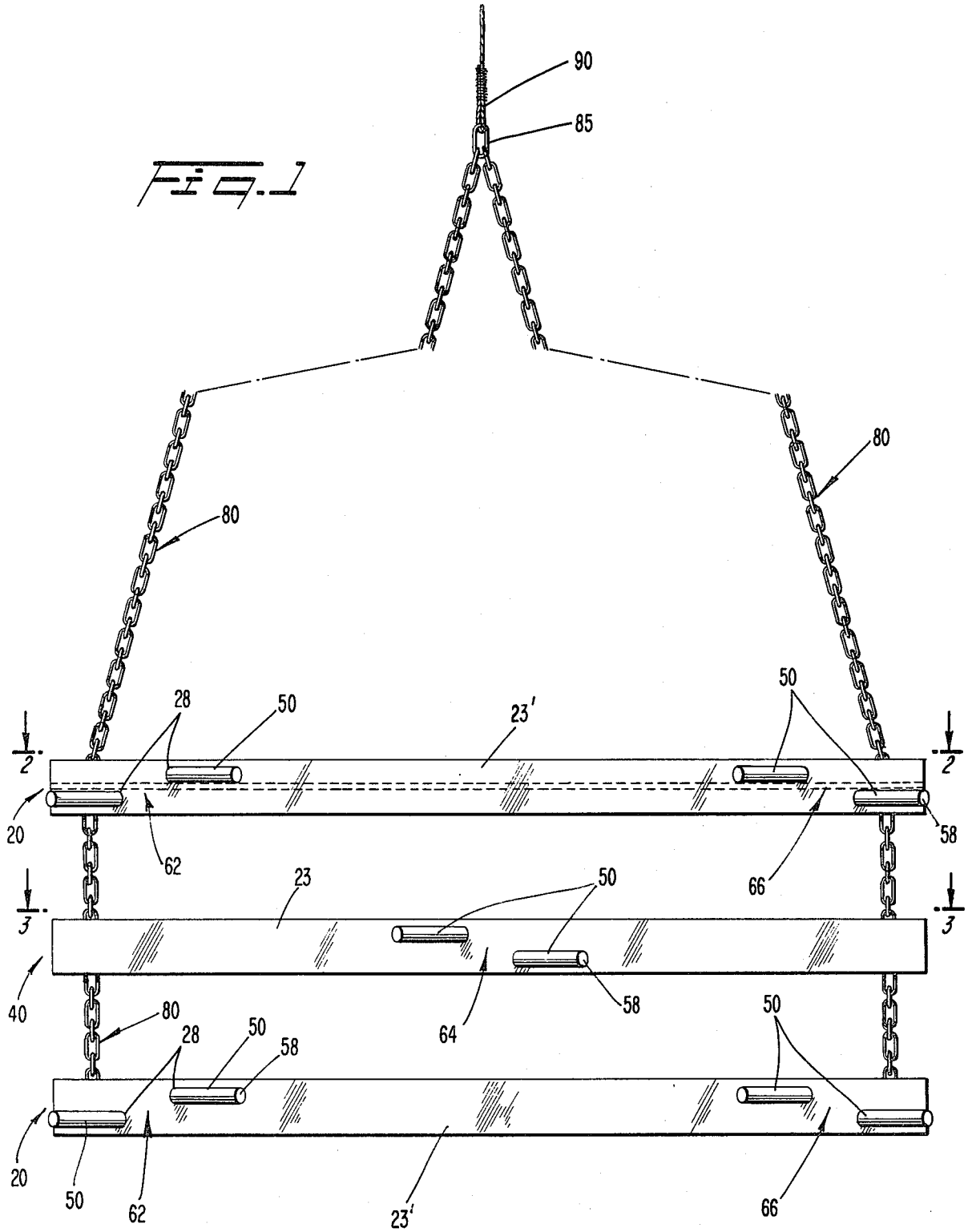
FIG. 1 is a side view of a preferred embodiment of a wall brush according to the present invention.

With reference to FIG. 1, a wall brush 10 embodying the invention includes three housing members for housing a plurality of scraper elements. Two first housing members or stabilizer members 20, which will hereafter be referred to as "A" stabilizers, are disposed on both sides of a second stabilizer member 40, which will hereafter be referred to as a "B" stabilizer. The three stabilizers 20, 20, 40 may be connected to each other by a cable or preferably by an anchor chain 80. The anchor chain 80 and the stabilizers may be suspended from a crane cable 90 which is looped through a central link 85 in the anchor chain 80. The crane cable is in turn attached to a reciprocating mechanism such as a crane, shovel, or winch, not illustrated, which lowers and raises the wall brush 10. The anchor chain 80 may be looped through each end of each of the stabilizers or beams 20, 40 to connect them to each other. A plurality of elongated rod-like teeth 50 protrude from each stabilizer 20, 40.

Figure 2:
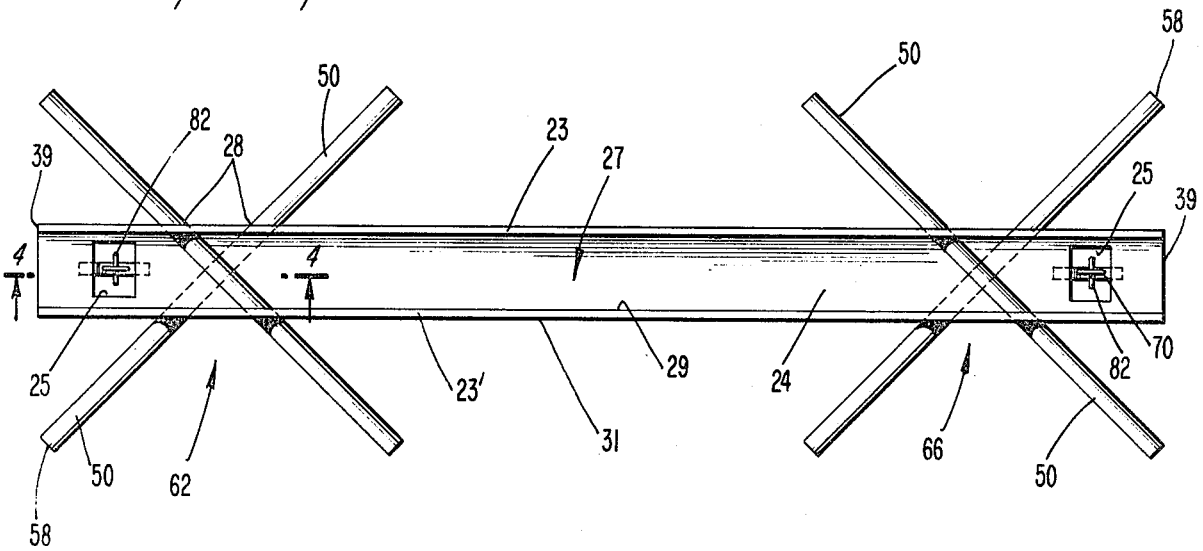
FIG. 2 is a top view along line 2—2 of FIG. 1.
Figure 3:
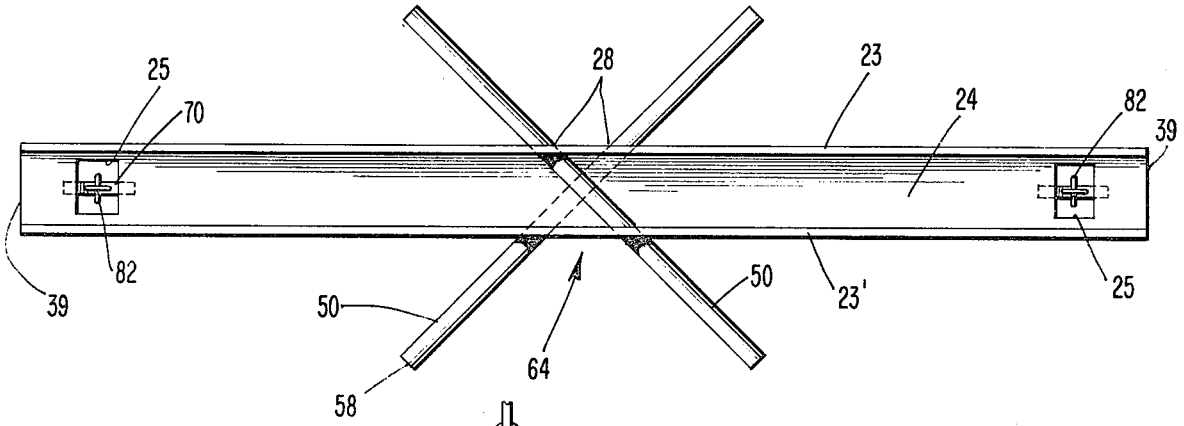
FIG. 3 is a top view along line 3—3 of FIG. 1.

With reference to FIGS. 2 and 3, each stabilizer 20, 40 is preferably an H-beam having two flanges 23, 23' which are as wide as a web 24 of the beam. The flanges 23, 23' may also be thicker than the web 24. The A stabilizer 20 has a left-end scraper 62 and a right-end scraper 66 and the B stabilizer 40 has a central scraper 64. Each of the scrapers 62, 64 and 66 is comprised of two teeth 50, which intersect one another at an approximately 90° angle and which are disposed through the flanges 23, 23' of the stabilizers in an X-shaped configuration. Naturally, other angles of intersection for the teeth 50 would also be usable. One of the teeth 50 of each pair is disposed above the web 24 of its respective H-beam with the other tooth of the pair being disposed below the web of its respective beam.

A plurality of holes 28 are provided on the flanges 23, 23' of each H-beam so that the teeth 50 can be inserted through them. Each of the teeth 50 is then welded both to an inside surface 29 and an outside surface 31 of each of the flanges 23, 23'. Each tooth 50 is also welded, depending on its location, to an upper surface 27 or lower surface 32 of the web 24 of the H-beam. In the preferred embodiment the teeth 50 are not secured to each other but of course a bolt, for example, could be passed through the two teeth 50 and the web 24 to secure them to each other. Each scraper 62, 64, 66 protrudes at an angle through the flanges 23, 23' of its H-beam 20, 40. The teeth 50 of the scrapers 62, 64, 66 protrude through both flanges 23, 23' to make the assembly reversible. The wall brush 10 may swivel on the crane cable 90 during operation so that it is advantageous that teeth be provided on both sides of the H-beam for scraping the wall face.

An end face 58 of each tooth in the preferred embodiment begins basically flat but is rounded off by contact with the wall face. However, one may put ribs, serrations, chisel shapes or points on the teeth to enhance the scraping action. The wear of the teeth 50 depends on the rock or other surface upon which the teeth operate. Therefore, wear would be fairly slow on a softer rock such as limestone but could be quite rapid on a harder rock such as granite. In order to take into consideration the more rapid wear on a harder surface, it may be advantageous to put a hardened surface on the end face 58 of each tooth 50. It may also be advantageous to put a pick or a like member containing a tungsten carbide bit or other hard material bit on the end face 58 of each tooth 50 to slow down rapid wear of the tooth 50 on hard rock.

Each tooth 50 may be replaceable without having to replace the entire stabilizer 20, 40. If, for example, a tooth 50 breaks on a jagged outcropping on the wall face, the tooth may be burned out from its weld connection with its stabilizer 20, 40, for example by the use of an acetylene torch, and replaced by another tooth. Of course if necessary the entire stabilizer 20, 40 may be replaced.

The left-end scraper 42 is preferably disposed on the A stabilizer 20 such that outer ends of each tooth 50 are in the same plane as an end surface 39 of the A stabilizer 20. The right-end scraper 46 is similarly disposed on the other end of the stabilizer. Thus, there is a large central portion on the A stabilizer 20 in which there is no scraper disposed. This insures that there will be less of a tendency for objects to get snagged on the teeth 50. It should be noted, however, that a central scraper could be disposed between the left end 42 and right end 46 scrapers on the A stabilizer 20.

A void 25 is provided near the left and right end surfaces 39 of each H-beam. The anchor chain 80 passes through each void 25 and links the three stabilizers together and also links the wall brush 10 with the crane cable 90. The voids 25 in both the A stabilizer 20 and the B stabilizer 40 are preferably positioned in the same location on each stabilizer so that the chain does not bind on an edge of any of the voids.

Figure 4:
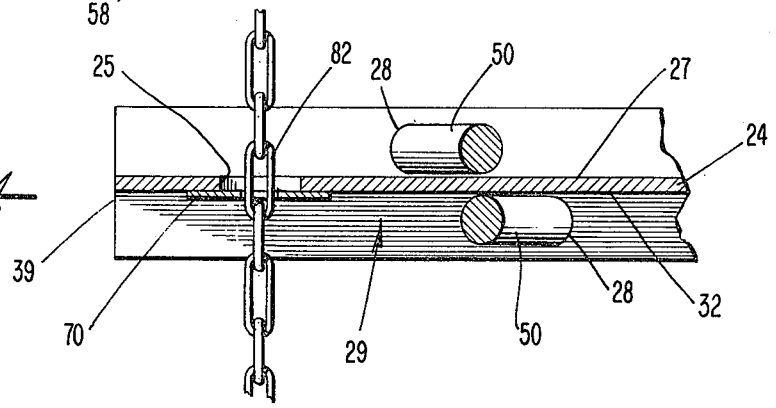
FIG. 4 is a cross-sectional view along line 4—4 of FIG. 2.

With reference now to FIG. 4, an end portion of the A stabilizer 20 includes the void 25 through which a chain link 82 is disposed. The chain link 82 is kept within the void 25 by a chain keeper pin 70 which is welded to the underside 27 of the web 24 of the A stabilizer 20 and is disposed through the chain link 82. The chain keeper pin 70 is so welded to prevent the anchor chain 80 from moving up and down with respect to the A and B stabilizers. The chain keeper pins 70, aided by gravity, thus keep the stabilizers in a substantially constant position with respect to each other. If a cable were used rather than an anchor chain 80 to connect the stabilizers to each other and the crane cable, a cable clamp would be used rather than the chain keeper pin 70 to secure the cable with respect to each beam.

The holes 28 in the flange 23 of the A stabilizer 20 have disposed through them the teeth 50 of the left-end scraper 62. One tooth 50 is disposed above the web 24 of the H-beam and the other tooth 50 of the left-end scraper 62 is disposed below the web 24.

Primarily, it is the teeth 50, rather than the stabilizers 20, 40 themselves, which remove loose material from the surface of the wall face. At the top of the wall face or rock face, however, as the assembly 10 is hoisted over the side, the stabilizers 20, 40 may also come into contact with the rock face and do a limited amount of scraping themselves. It is advantageous that only the teeth contact the rock face because in this way it is easier to "back off" the assembly 10, that is, space the assembly away from the rock face, than would be the case if an entire longitudinal face of each stabilizer 20, 40 contacted the rock face.

There are preferably three stabilizers, two A stabilizers and a B stabilizer, because this configuration seems to provide enough weight to hold the teeth 50 against the wall face and yet allows an easy release from the wall face to prevent a hangup on rocks or crevices on the wall face. The anchor chain 80 and cable 90 also allow enough flexibility so that the entire assembly 10 can yield or flex rather than hanging up on the rocks. Because the entire weight of the wall brush 10 is transmitted to the rock face by the end faces 58 of the teeth 50, the end faces 58 having a relatively small area such as two and a half inches in diameter in the preferred embodiment, enough pressure is put on the rock face to dislodge loose material from it. The length of the crane cable necessary for reciprocation is ideally long enough so that the wall brush 10 can reach a bottom of an excavation and the crane sits far enough behind the rock face so that there is no danger of the weight of the crane causing the top of the rock face to collapse.

In operation, two or three operators are normally required to work the wall face. An observer or monitor stands at a distance away from the wall face or rock face on a quarry floor or perhaps is situated on an opposite face of the quarry and may have a telescope or a pair of binoculars or a close-up TV camera through which to observe the condition of the face and the wall brush 10. The monitor determines whether all the loose material has been dislodged by the wall brush 10 from a particular section of the rock face. The monitor communicates his observations on a walkie-talkie or another means of communication, to a second operator who is standing near the crane above the wall face. The second operator then tells a crane operator whether to reciprocate the wall brush 10 on the same section of the rock face again or to move the wall brush 10 to another section of the rock face because the first section had been cleared of loose material. If the crane operator has a set of earphones and a microphone through which to communicate with the monitor, then only two operators are necessary to work the wall face. In a large operation, it may be possible to have a single observer, using closed-circuit television screens in a central control room, monitor simultaneously the operation of several wall brushes operating at different locations in a quarry.

In a preferred embodiment of the present invention, the teeth are made from a cold rolled shafting material. The teeth are 2½ inches in diameter and are 51 inches long with each tooth 50 of the scrapers 42, 44, 46 projecting 12 inches from the outer surface 31 of its respective stabilizer flange 23, 23'.

Each stabilizer 20, 40 is preferably a W10X49 H-beam, that is, an H-beam having a 10-inch depth and weighing 49 pounds per linear foot. The flanges 23, 23' on the H-beam are also ten inches wide and the web of the beam is 0.340 inches thick with the flanges being 0.558 inches thick. The voids 25 are preferably disposed eight inches from respective end surfaces 39 of each H-beam with the H-beam being preferably made from a mild steel material. The three stabilizers are preferably spaced approximately 31 inches from each other.

The anchor chain 80 preferably has six-inch links and is made from a medium carbon steel. The crane cable 90 is preferably just looped through the central link 85 in the anchor chain and cable clamps secure the cable to itself. The crane cable 90 is preferably spaced approximately twenty feet from the nearest stabilizer. The chain keeper 70 is preferably made of an ordinary mild steel rod.

In the preferred embodiment the three beams, the anchor chain and the teeth together weigh approximately 1½ tons. Naturally, a greater or lesser weight would be acceptable as long as an adequate amount of pressure was exerted on the ends 58 of the teeth 50 contacting the wall face.

As indicated previously, the length of crane cable necessary for reciprocation is ideally long enough to reach the bottom of the wall surface which is to be scraped. For example, for a 165 foot deep excavation, a 225-foot cable was found suitable in order to reach bottom and to provide some slack. The crane would sit at a safe distance behind the wall face or rock face, the distance being partially determined by the length of the boom and the angle of the boom. In a preferred embodiment the crane sat approximately 30 to 40 feet behind the edge of the rock face.

The principles, preferred embodiments and modes of operation of the present invention have been described in the foregoing specification. The invention which is intended to be protected herein should not be construed as limited to the particular forms disclosed, since these are to be regarded as illustrative rather than restrictive. Variations and changes may be made by those skilled in the art without departing from the spirit of the present invention as reflected in the appended claims.

We claim:

1. A wall brush for dislodging loose material from a wall face, comprising:

scraper means for contacting the wall face and dislodging loose material therefrom;

housing means for housing said scraper means with a longitudinal face of said housing means being parallel to the wall face, said scraper means projecting outwardly from said longitudinal face, said housing means comprising at least one H-beam wherein the scraper means comprises at least one pair of elongated rod-like teeth which are disposed perpendicularly with respect to each other so that both ends of both teeth project outwardly from said housing means, said elongated rods being secured to said housing means; and suspension means for flexibly suspending said housing means.

2. The wall brush of claim 1 wherein said elongated rods are welded to said housing means.

3. A wall brush for dislodging loose material from a wall face, comprising:

scraper means for contacting the wall face and dislodging loose material therefrom;

housing means for housing said scraper means with a longitudinal face of said housing means being parallel to the wall face, said scraper means projecting outwardly from said longitudinal face wherein said housing means comprises three H-beams with said scraper means comprising of a plurality of X-shaped scrapers which are disposed perpendicularly with respect to first and second flanges of said H-beams and project past said flanges, said X-shaped scrapers being welded to said housing means; and suspension means for flexibly suspending said housing means.

4. A wall brush for dislodging loose material from a rock face comprising:

at least one X-shaped scraper element;

at least one beam to which said at least one scraper element is secured such that end portions of said scraper element project outwardly past flange portions of said beam; and a chain by which said at least one beam is suspended.

5. The wall brush of claim 4 wherein there are two scraper elements disposed on end portions of said at least one beam.

6. The wall brush of claim 4 wherein said at least one scraper element is disposed on a central portion of said at least one beam.

7. The wall brush of claim 4 wherein there are three H-beams with an upper and a lower H-beam each having two scraper elements disposed on end portions of said upper and lower beams, and with a middle H-beam having a centrally located scraper element.

* * * * *